US005271124A

United States Patent [19]

Sandell

[11] Patent Number: 5,271,124

[45] Date of Patent: Dec. 21, 1993

[54] HINGE SUITABLE FOR USE IN A ROOF WINDOW ASSEMBLY

[76] Inventor: Anthony C. Sandell, 1 Northfolk Lane, Rosebank, Cape Town, South Africa

[21] Appl. No.: 693,913

[22] Filed: Apr. 29, 1991

[30] Foreign Application Priority Data

Apr. 30, 1990 [ZA] South Africa ..... 90/3285

[51] Int. Cl.[5] ..... E05D 15/32; E05D 11/06; E04B 7/18

[52] U.S. Cl. ..... 16/370; 16/371; 52/200

[58] Field of Search ..... 16/370, 371; 49/483, 49/383; 52/207, 72, 200

[56] References Cited

U.S. PATENT DOCUMENTS

| | | | |
|---|---|---|---|
| 2,355,542 | 8/1944 | Loftin | 16/371 |
| 4,446,597 | 5/1984 | Dantzer-Sorensen et al. | 16/370 |

FOREIGN PATENT DOCUMENTS

| | | | |
|---|---|---|---|
| 722328 | 10/1963 | Belgium . | |
| 22657 | 1/1981 | European Pat. Off. | 16/370 |
| 352206 | 1/1990 | European Pat. Off. . | |
| 2503519 | 8/1976 | Fed. Rep. of Germany | 52/200 |
| 8105219 | 11/1981 | Netherlands . | |
| 364346 | 6/1957 | Switzerland . | |
| 2234 | 3/1910 | United Kingdom | 16/370 |

OTHER PUBLICATIONS

Bouwwereld, vol. 65, No. 22, Oct. 24, 1969, Doetinchem NL 'het nieuwe velux dakvenster type GGL commercial supplement.

Blefa, a brochure entitled "Model BL centre-hung attic roof window for luxurious atmosphere", 1 page, labeled Exhibit A.

Roto, a brochure entitled "Abbaino Roto WDF 410", 2 pages, labeled Exhibit B.

Velux, an untitled brochure, 4 pages, labeled Exhibit C.

Braas, a brochure entitled "Braas Roof Window BL/BK", 2 pages, labeled Exhibit D.

*Primary Examiner*—Lowell A. Larson
*Assistant Examiner*—Carmine Cuda
*Attorney, Agent, or Firm*—Merchant, Gould, Smith, Edell, Welter & Schmidt

[57] ABSTRACT

The invention provides a hinge suitable for use in a roof window assembly having a frame and a movable sash, connected to each other by a pair of hinges according to the invention. Each hinge includes a first hinge element connectable to the frame and a second hinge element connectable to the sash. A pair of linkages, each pivotally connected to both hinge elements is so arranged as to allow rotational movement of the sash through angles exceeding 120 degrees.

3 Claims, 8 Drawing Sheets

HINGE SUITABLE FOR USE IN A ROOF WINDOW ASSEMBLY

FIELD OF THE INVENTION

This invention relates to a hinge. More particularly, the invention relates to a hinge for use in a window assembly.

BACKGROUND TO THE INVENTION

The use of roof windows in the roofs of buildings for providing natural illumination in attics or in upstairs living quarters in domestic dwellings and other buildings is well-known.

A roof window assembly within the meaning of the present invention generally comprises a frame which is connectable to a surrounding roof structure. The connection between the frame and roof structure is suitably sealed in order to prevent intrusion of moisture from the roof into the space beneath the roof. A movable sash comprising a window pane is supported with clearance within the frame, usually by way of a pivotal connection.

Any clearance space allowed between the frame and sash for movement of the sash must be covered by suitable means for preventing any intrusion of moisture through this space, at least when the window assembly is in its closed condition. This may be achieved in known fashion by way of complementary flange formations connected to and arranged along the periphery of either the sash or the frame, or both, whereby a substantially weather-proof overlap between the frame and sash is achieved. The flange formations may either form an integral part of the sash and/or frame, as the case may be. Alternatively, sheet metal flashing may be connected to the sash and/or frame in order to overlie the clearance space between the sash and frame. Rotation of the sash in relation to the frame is usually limited, however, to approximately 90°, by reason of the interference of the flange formations or flashing with adjacent portions of the window assembly.

This limitation is overcome at least partially in a roof window assembly known to the applicant in which externally mounted pivotal connections are provided between the frame and sash. Each connection is located adjacent to an overlapping joint between a portion of flashing secured to the sash and a further complementary portion of flashing secured to the frame. This arrangement allows the sash to be rotated through an angle in excess of 90° about its pivotal axis while allowing the flashing connected to the sash to pass with clearance underneath the flashing of the frame when the assembly is in its closed condition. This assembly has the disadvantage, however, of leaving the pivotal connections exposed to the prevailing weather conditions, leading to their eventual deterioration.

In yet a further roof window assembly known to the applicant the pivotal connections provided between the sash and frame, are displaceable along tracks whereby the sash is outwardly displaceable in relation to the frame in order to provide sufficient clearance between the flashing of the sash and frame for rotation of the sash through angles in excess of 90°. The track portions and the components co-operating with these must be manufactured and fitted with relatively close mechanical tolerances, which makes this type assembly comparatively expensive.

It is an object of this invention to provide a hinge for use in a roof window assembly of the kind described above having relatively few components while allowing unimpeded rotation of the sash through an angle of at least 90°.

It is a further object of this invention to provide a roof window assembly having flashing for providing a weather-proof seal between its frame and sash, in which a portion of the flashing secured to the sash is allowed to pass with clearance underneath a portion of the flashing secured to the frame whenever the roof window assembly is brought towards its closed condition.

SUMMARY OF THE INVENTION

According to the invention there is provided a hinge which includes

- a first hinge element connectable to a stationary member;
- a second hinge member arranged in juxtaposition the first hinge element and connectable to a movable member; and
- a pair of linkages, each being pivotally connected to the first and second hinge elements, the pivotal connections being so arranged that, in use, a reference axis passing through the pivot points of the second hinge element passes through an angle of at least 90° in relation to its initial orientation when the hinge is displaced from its fully closed towards its fully opened condition.

The spacing between the pivot points of the first hinge element may be greater than that between the pivot points of the second hinge element.

The first and second hinge elements are preferably in the form of flat plates, and more particularly flat metal plates. In preferred embodiments of the invention the linkages, also preferably formed from flat metal plates, are arranged between the first and second hinge elements.

The pivotal connections between the hinge elements and linkages may be formed by pins extending perpendicularly to, and passing through circular holes defined by the hinge elements and linkages.

The linkages may be so shaped as to define edges whereby the linkages are permitted to abut against each other, the fully opened and fully closed conditions of the hinge being defined by respective orientations of the linkages in relation to each other, in which the edges of the linkages bear against each other.

The invention extends to a roof window assembly which includes

- a frame mountable in a surrounding structure; and
- and a window sash fitting into the frame with clearance and connected to the frame along two of its opposing edges by way of a pair of hinges, each hinge having a first hinge element connected to the frame and a second hinge element arranged in juxtaposition to the first hinge element and connected to the sash, each hinge further having a pair of linkages pivotally connected to both of their respective first and second hinge elements, the pivotal connections being so arranged that, in use, the sash passes through an angle of at least 90° in relation to its initial orientation when the sash is displaced from its fully closed towards its fully opened condition.

The roof window assembly may further include flashing overlying the clearance space between the frame and sash when the window assembly is in its fully closed condition. The flashing may comprise separate portions connected respectively to the frame and sash. More particularly, the portion of the flashing connected to the frame may overlie the portion connection to the sash when the window assembly is in its fully closed condition.

A further portion of flashing may be provided, arranged around the periphery of the frame, the portions of flashing connected to the frame and sash each partially overlapping the further portion of flashing when the window is in its fully closed condition.

The hinge elements and linkages are preferably so arranged that, in use, the flashing connected to the sash is allowed to pass freely underneath the flashing connected to the frame when the window assembly is brought into its fully closed condition. The frame may be provided with reccesses in the region of overlap between the portions of flashing connected the sash and frame in order to allow the flashing connected to the sash to pass freely underneath the flashing.

DESCRIPTION OF THE DRAWINGS

The invention is described below by way of example with reference to the accompanying diagrammatic drawings in which.

DESCRIPTION OF A PREFERRED EMBODIMENT OF THE INVENTION

Figure 1A:
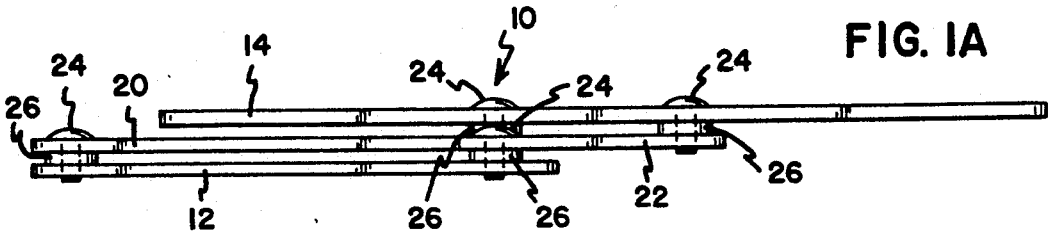
FIG. 1*a* shows a side elevation of a hinge according to the invention in its fully closed condition.

In the accompanying drawings reference numeral 10 denotes generally a hinge according to the invention.

The hinge 10 includes pressed metal plates 12 and 14, spaced apart from each other and arranged parallel in juxtaposition to each other, constituting first and second hinge elements respectively. The plate 12 has a pair of circular holes 16 and the second hinge element 14 has a pair of circular holes 18, all having the same diameter. The spacing between the holes 16 is larger than that between the holes 18, as appears from FIGS. 2, 3 and 4. When the hinge 10 is in its fully closed condition (FIG. 2) one of the holes 16 is substantially in alignment with the holes 18 while the other hole 16 is located approximately adjacent to the hole 18 closest to the first-mentioned hole 16.

Figure 2:
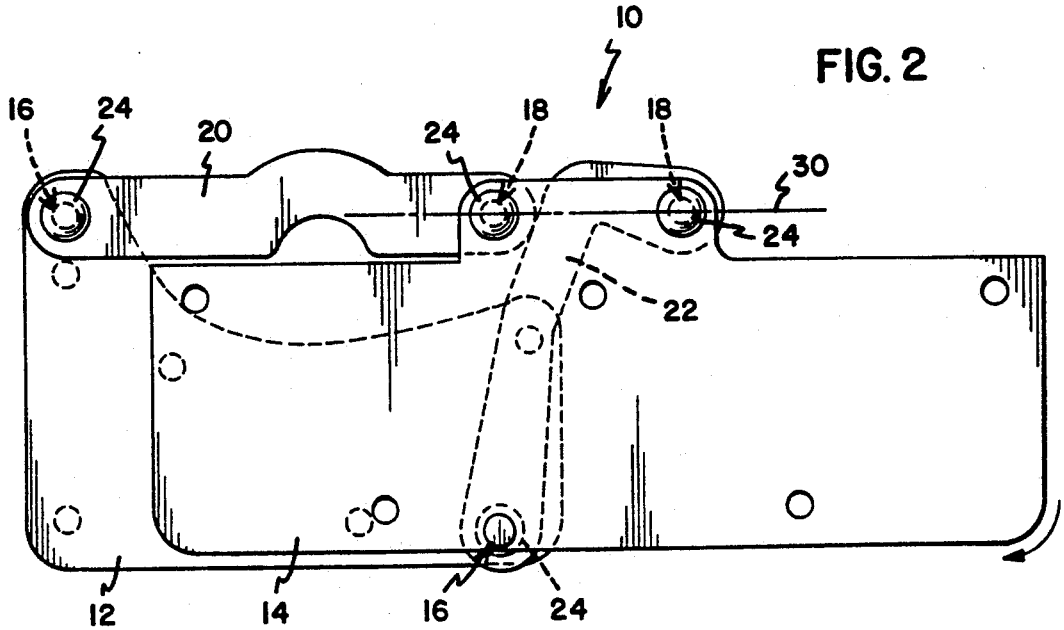
FIG. 2 shows an upper plan view of the hinge of FIG. 1*a* in its fully closed condition.

Linkages 20 and 22 formed of metal plate are arranged between the plates 12 and 14 as appears from FIG. 2. The linkages 20 and 22 have circular holes matching the holes 16 and 18 allowing pivotal connections between the plates 12 and 14 to be formed by pivot pins 24 passing perpendicularly through the plates and linkages.

Annular plastic spacers 26, held captive by the pivot pins 24 are arranged between the plates 12, 14 and the linkages 20 and 22 as shown in FIG. 1*a* in order to permit unobstructed movement of the plates and linkages in relation to each other.

The plates 12 and 14 are provided with drilled holes 28 for mounting the hinge 10 to a stationary and a movable member respectively, as will appear from the further discussion below.

The improved hinge 10 shown in FIG. 16 is substantially similar in structure to the hinge shown in FIG. 1*a*. The spacers 26' are preferably of a nylon, however, in order to maintain a desired degree of friction between the plates 12' and 14' and the linkages 20' and 22'. A predetermined amount of force is accordingly required in overcoming this friction in order to displace the plates 12' and 14' in relation to each other. This feature has the advantage that roof window assemblies incorporating hinges 10' are restrained from being open or shut at random by light gusts of wind.

The pivot pins 24' of the hinge 10' have flattened heads which are recessed within their adjacent plates 12' and 14', as the case may be. Lubricated washers 29' are further provided at the opposing ends of these pivot pins in order to minimise wear on the pins and plates 12' and 14' in the regions of relative movement between these components.

Figure 5:
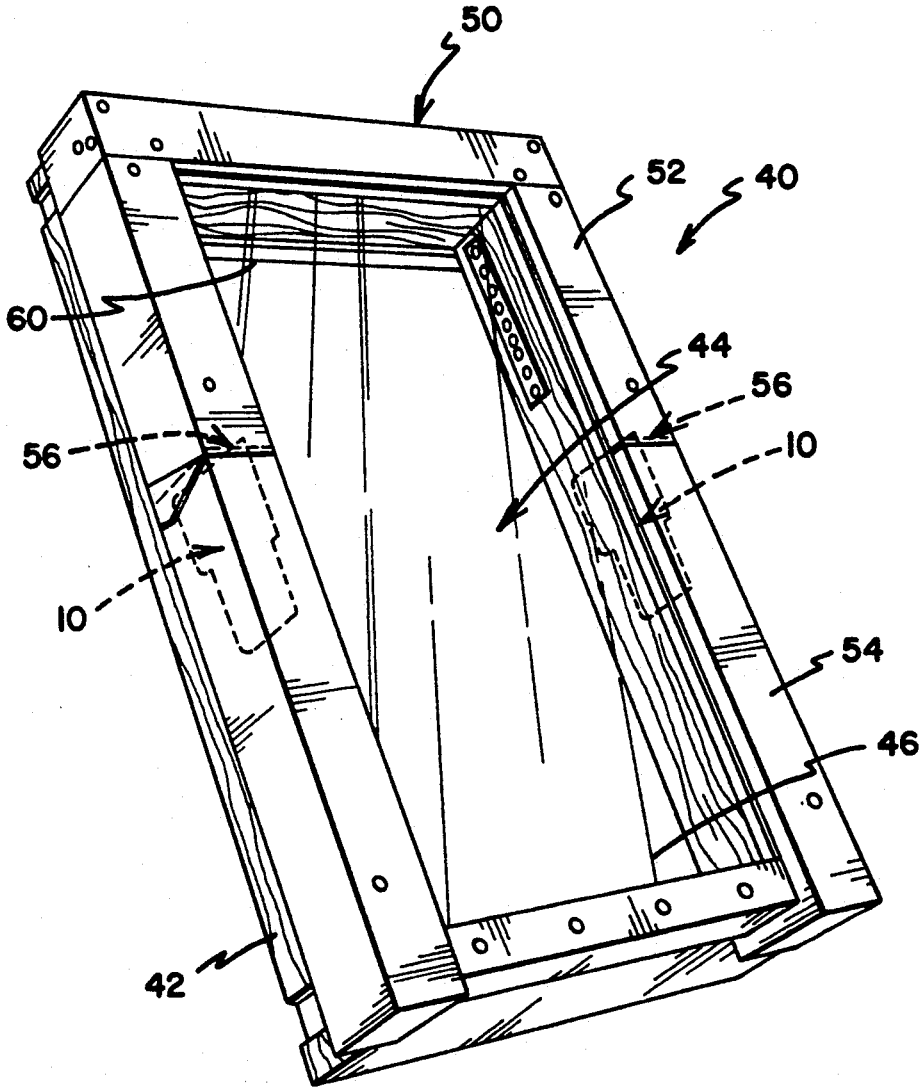
FIG. 5 shows a perspective view of a window assembly according to the invention in its fully closed condition, incorporating a pair of hinges of the type shown in FIG. 1*a;*

In a preferred application of the invention shown in FIG. 5 a pair of hinges of the type described above is used in a roof window assembly denoted generally by reference numeral 40. The assembly 40 comprises a stationary rectangular timber frame 42 which is connectable to a roof structure (not shown). A movable window sash 44 comprising a window pane 46 supported in a rectangular timber frame 48 fits with clearance into the frame 42.

Figure 6:
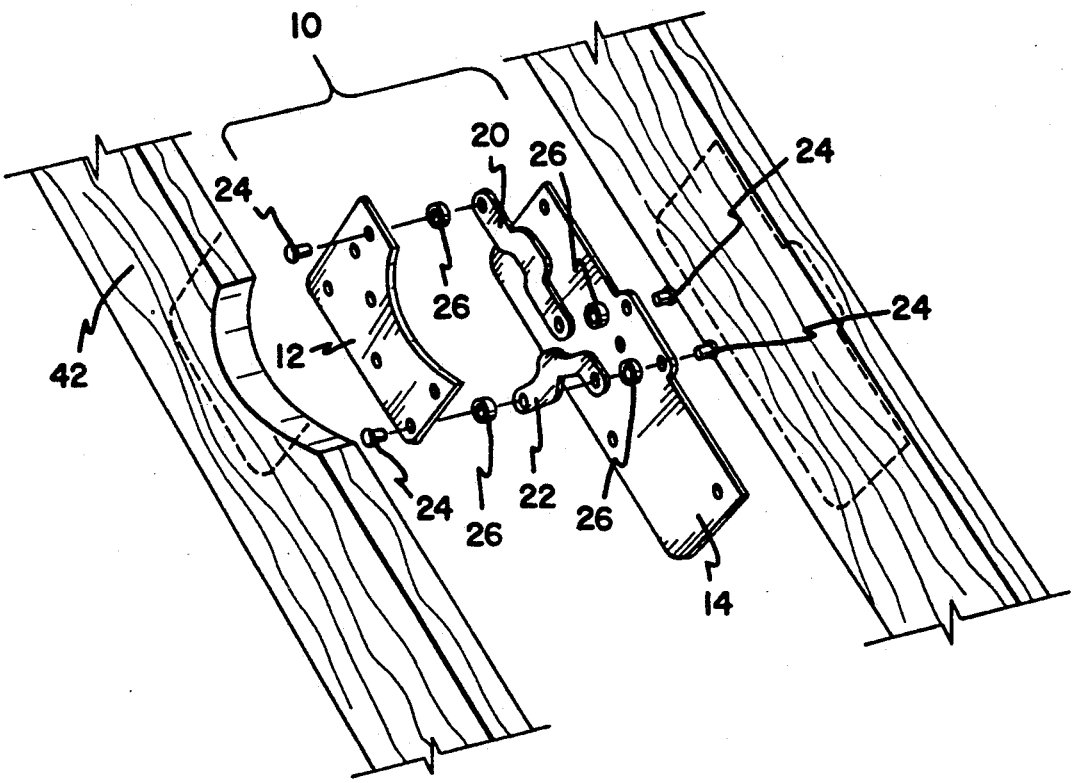
FIG. 6 shows an exploded view of the circled portion of the window assembly of FIG. 5 on an enlarged scale.

FIG. 6 illustrates the method whereby the frame 42 is connected to an adjacent portion of the sash 44 by way of a hinge 10. The metal plate 12 is secured to the left hand member of the frame 42 by means of wood screws (not shown) passing through the drilled holes 28 and screwed into the timber of the frame. The plate 14 is secured in similar fashion to a corresponding portion of the frame 48 ensuring that the sash fits into the frame 42 with sufficient clearance to allow free movement of the sash. The hinge 10 is fitted in its assembled state, the drilled holes 28 being readily accessible during manufacture by suitable rotation of the sash 44 in relation to the frame 42.

A further hinge (not shown) having the same components as the hinge 10 shown in FIG. 6 is fitted between the right hand members of the frames 42 and 48 shown in FIG. 5. The respective is mirror-inverted in relation to the arrangement of FIG. 6. The plates 12 of the two hinges will accordingly face each other from within the frame 42 while the plates 14 are located in corresponding positions on the frame 48 to allow it to fit with clearance into the frame 42.

In order to render the roof window assembly weatherproof it is provided with metal flashing generally denoted by reference numeral 50 extending across the spaces between the outer periphery of the frame 48 and the inner edges of the frame 42 when the assembly 40 is in its closed condition. A first stationary portion 52 of metal flashing is connected to the frame 42 and a movable portion 54 is connected to the sash 44 as appears from FIG. 5. It is an important aspect of this invention that the leading edges 56 of the movable portion 54 of the flashing pass underneath the stationary portion 52 in order to provide a suitable overlap between these portions.

Figure 3:
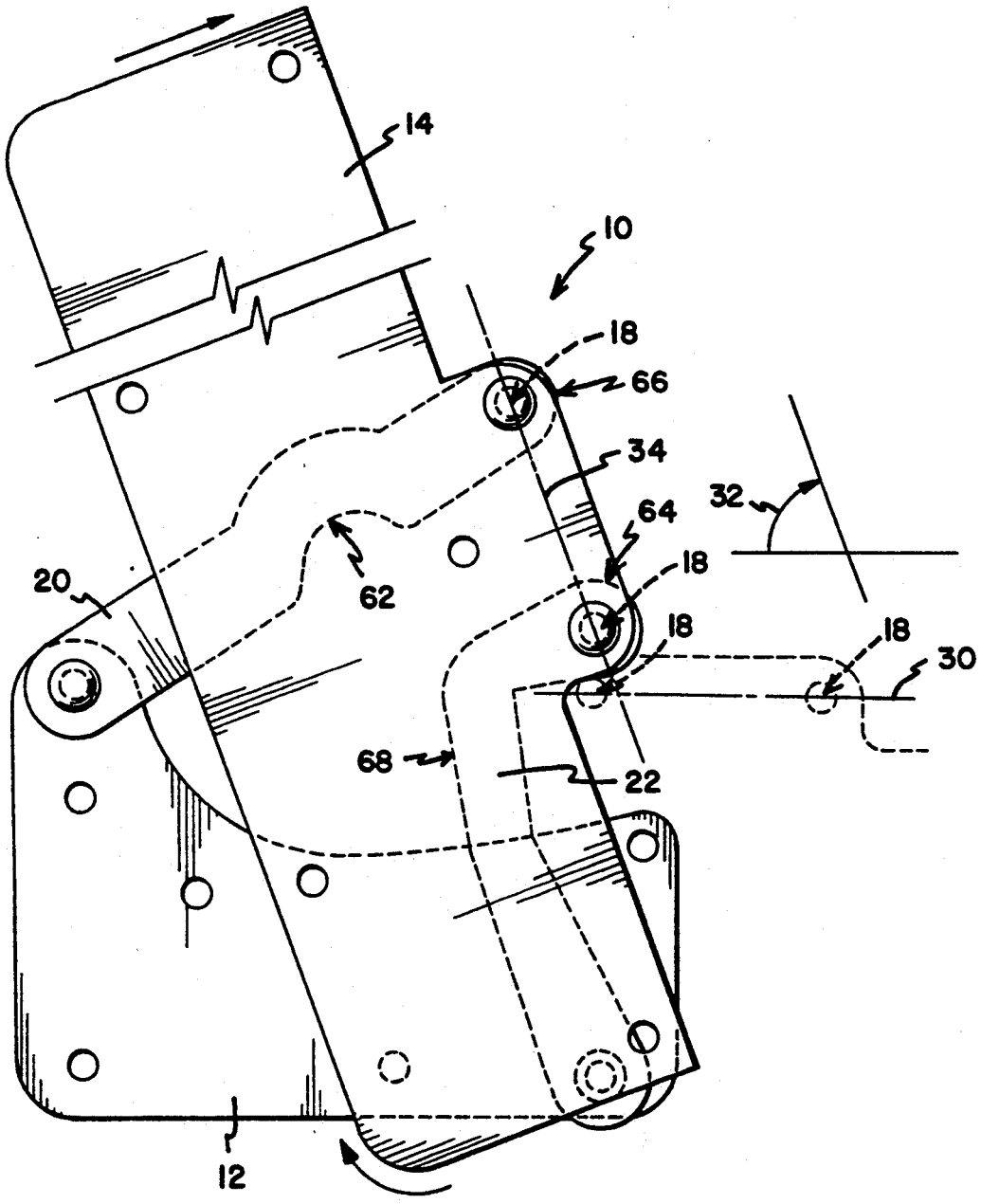
FIG. 3 shows an upper plan view of the hinge of FIG. 2 in a partially opened condition.
Figure 4:
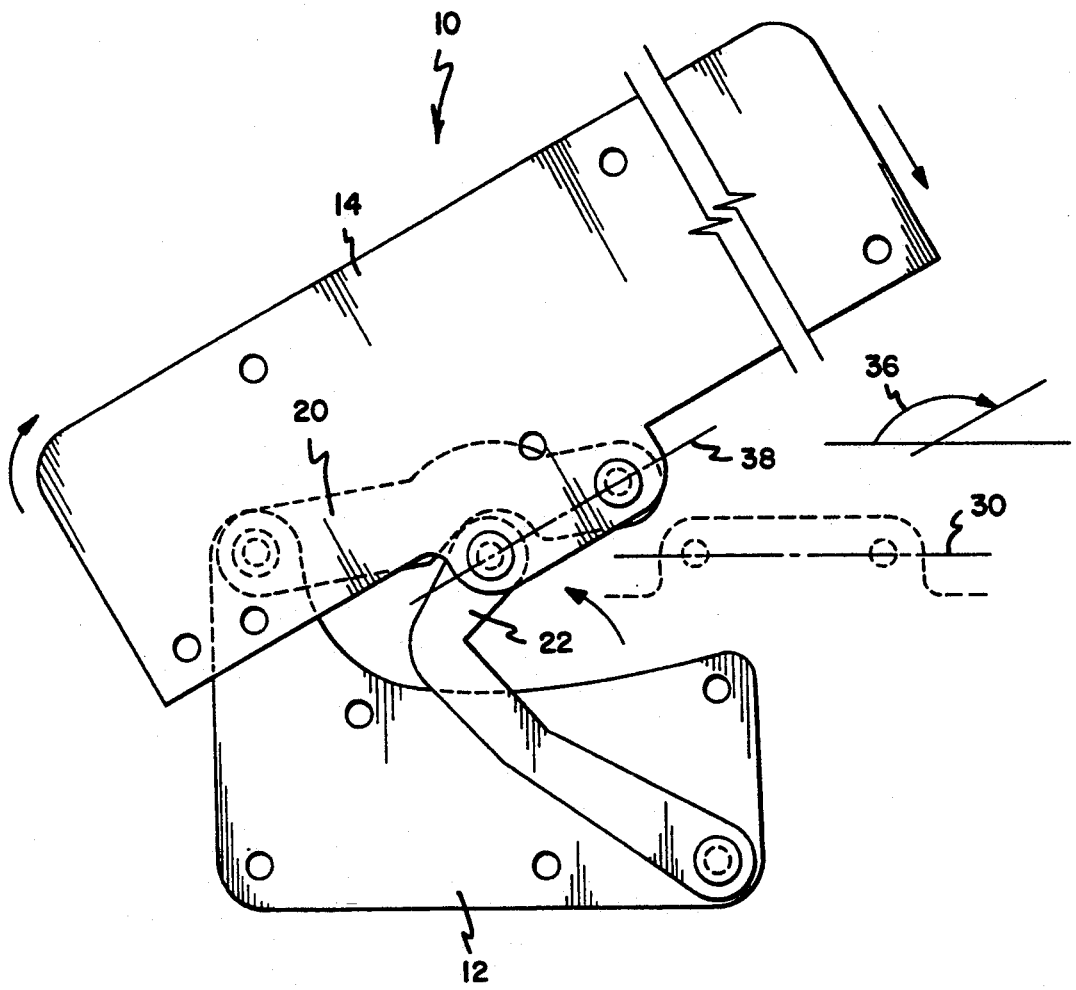
FIG. 4 shows an upper plan view of the hinge of FIG. 3 in its fully opened condition.

The manner in which this overlap is achieved is best understood by reference to FIGS. 2, 3 and 4. The closed condition of the window assembly 40 corresponds to the closed condition of the hinge 10 as shown in FIG. 2. The centres of the holes 18 of the plate 14 are aligned along an imaginary axis 30.

As the window sash 44 is moved to its partially opened condition (FIG. 7) the plate 14 of each hinge is displaced to a position approximately as shown in FIG. 3. It is evident that this displacement involves a composite movement having a linear and a rotational component. The pivot-points centered at the holes 18 are displaced both axially and laterally in relation to the axis 30; the plate 14 furthermore undergoes rotation through an angle 32 formed by transposition of the axis 30 and the corresponding axis 34 after displacement of the plate.

It is apparent from FIG. 3 that the hole 18 associated with the lever arm 22 follows an arcuate path adjacent to the reference axis 30 when the hinge 10 is displaced from its fully closed towards its open position. It is further evident that the portion of the plate 14 adjacent to this hole 18 initially moves away from the reference axis 30 as a result of the rotational movement imparted in this plate by the joint action of the linkages 20 and 22.

Figure 8:
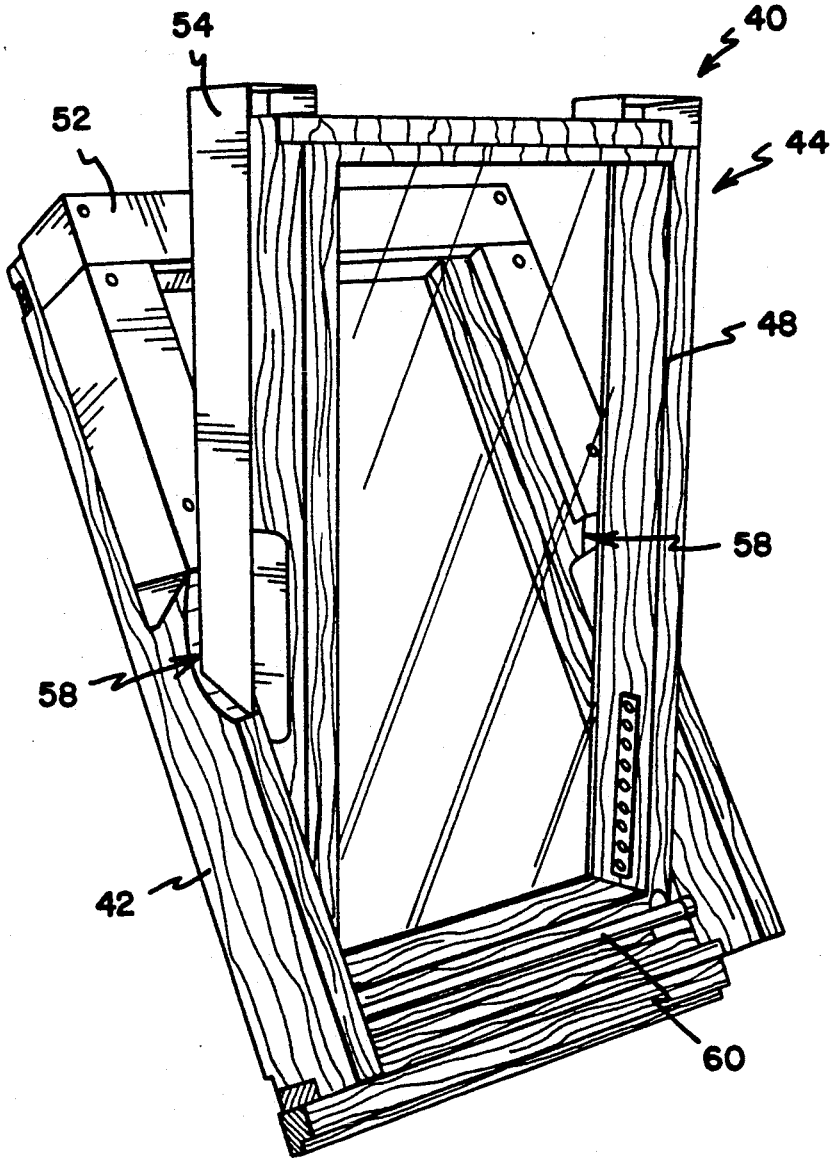
FIG. 8 shows the window assembly of FIG. 5 in its fully opened condition.

The leading edges 56 of the movable flashing 54 are located in close proximity to the abovementioned portion of each plate 14 in the window assembly 40 FIG. 8). These leading edges accordingly have to be initially displaced away from the stationary portion 52 of the flashing 50 as the hinges, and hence the sash 44 moves from the fully closed towards the fully open condition. Similarly, when the motion of the sash 44 is reversed, the leading edges 56 will not snag the stationary portion 52 of the flashing 50.

The side members of the frame 42 each have cutaway portions 58 of which is illustrated in FIG. 6. The leading edges 56 of the movable flashing 54 are accordingly permitted to move without obstruction past the frame members 42 while the sash 44 undergoes rotational displacement.

Figure 7:
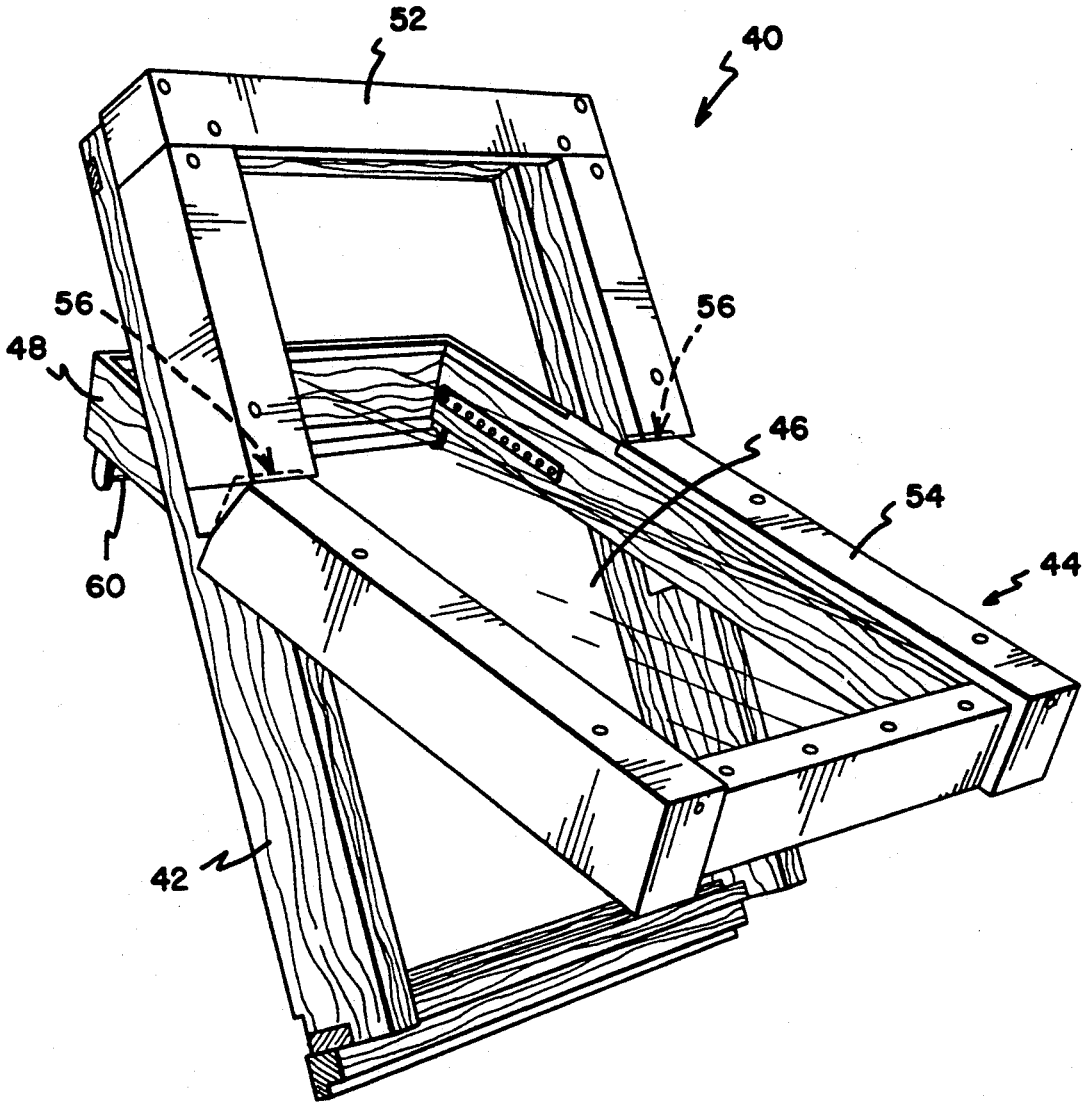
FIG. 7 shows a perspective view of the window assembly of FIG. 5 in a partially opened condition.

The sash 44 is provided with a handle 60 visible in FIGS. 5, 6 and 7 which is drawn downwardly in order to open the sash. The sash ultimately reaches its fully open condition illustrated in FIG. 8, when the handle 60 is at its lowest point and facing outwardly from the roof structure to which the assembly 40 is connected.

The fully open condition of the sash shown in FIG. 8 corresponds with the fully open condition of the hinge shown in FIG. 4. During transition from the fully closed to the fully open condition the plate 14 and hence the sash 44 undergo a rotation approaching 170° . illustrated by the angle 36 which is formed by transposition of the axes 30 and 38 shown in FIG. 4. As appears from FIG. 8 the outwardly facing surface of the window pane 48 is readily accessible for cleaning from within the building to which the frame 42 is connected.

Figure 1B:
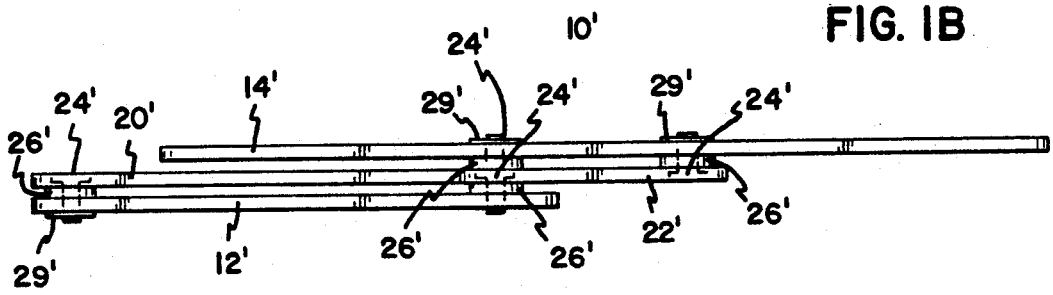
FIG. 1*b* shows a side elevation of an improved hinge similar to that of FIG. 1*a;*

The linkages 20 and 22 are designed to have edges which bear against each other when the hinge 10 is either in its fully open or in its closed condition. More particularly, the edges 62 and 64 provided on the linkages 20 and 22 respectively at the regions shown in FIG. 3 bear against each other when the hinge 10 is in its fully open position shown in FIG. 4. Similarly edges 66 and 68 on the linkages 20 and 22 respectively bear against each other when the hinge 10 is in its fully closed condition (FIG. 1).

Figure 9:
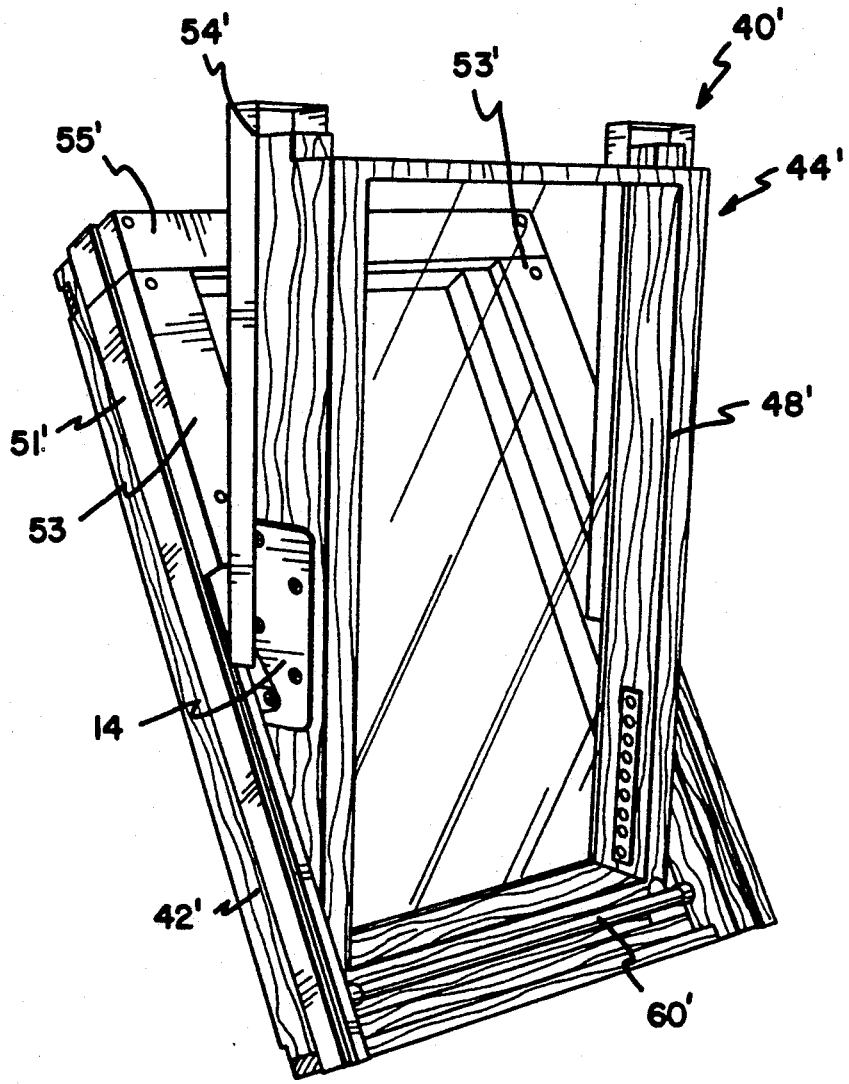
FIG. 9 shows a perspective view of an improved window assembly similar to that of FIG. 5 in its fully opened condition.

In an improved roof window assembly 40' shown in FIG. 9, which is structurally similar to the assembly 40 described above, the flashing comprises 4 portions.

A first portion 51' is fitted flush with the outer periphery of the frame 42' and has inwardly stepped portions extending adjacent to the outer edges of the frame. Two lateral portions of flashing 43' in the shape of inverted channels are arranged along the vertical members of the frame 42', overlapping the first flashing portion 51' along its inwardly stepped portions. The flashing 53' is supported by brackets (not shown) connected to the frame 42 in order to provide a clearance space between the frame 42' and the flashing 53', thereby permitting movement of the leading edges of the flashing 54', connected to the sash 44', past the flashing 53'. The flashing 54' corresponds substantially to the flashing portion 54 in FIGS. 5, 7 and 8.

A hood 55' completes the flashing on the frame 42', and is arranged along the upper cross-member of the frame in overlapping relationship with both the flashing portions 51' and 53'. The flashing portion 51' allows a weatherproof joint to be formed between the frame 42' and its surrounding support structure (not shown). The hood 55' serves to avoid moisture Ingress through the clearance space formed between the upper adjacent edges of the frame 42' and sash 44' when the assembly 40' is in its closed condition.

The flashing 54' is provided with lateral skirting extending with clearance along the outer edges of the sash 44'. This skirting overlaps the inwardly stepped portions of the flashing 51' when the window assembly 40' is in its closed condition thereby rendering the entire assembly substantially weatherproof in this condition.

The side members of the frame 42' are generally narrower than the corresponding members of the frame 42, and accordingly do not require any cutaway portions corresponding to the cutaway portions 58 of the assembly 40 (FIG. 8).

The applicant envisages that the hinges and roof window assemblies described above lend themselves to numerous adaptations and modifications without departing from the essential elements of the invention set out in more general terms in the preceding description of the invention and the accompanying claims. The scope of the invention should accordingly not be construed as being limited to the description of the preferred embodiments set out above.

I claim:

1. A hinge for use in a roof window assembly having a movable window sash fitting with clearance into a stationary frame, the hinge comprising:

a first planar hinge element connectable to the frame;

a second planar hinge element arranged in juxtaposition to the first hinge element and connectable to the sash, the second hinge element being arranged in a plane spaced from, and in parallel relationship to the first hinge element; and a pair of linkages each extending in a single plane and arranged in co-planar relationship with each other between the first and second hinge elements, and each pivotally connected to both the first and second hinge elements, the pivotal connections being so arranged that in use, a reference axis passing through the pivot points of the second hinge element passes through an angle of at least 120° in relation to its initial orientation when the hinge is displaced from its fully closed toward its fully open condition.

2. A roof window assembly comprising:

a frame mountable in a surrounding structure;

a window sash fitting into the frame with clearance and connected to the frame along two of its opposing edges by way of a pair of hinges, each hinge having a first planar hinge element connected to the frame and a second planar hinge element arranged in juxtaposition to the first hinge element and connected to the sash, the second hinge element being arranged in a plane spaced from and in parallel relationship to the first hinge element, each hinge further having a pair of linkages each extending in a single plane and arranged in co-planar relationship to each other between the hinge elements, and pivotally connected to both of their respective first and second hinge elements, the pivotal connections being so arranged that, in use, the sash passes through an angle of at least 120° in relation to its initial orientation when the sash is displaced from its fully closed towards its fully open condition.

3. A roof window assembly comprising:

a movable window sash fitting with clearance into a window frame which is mountable in a surrounding structure;

first and second flashing portions respectively secured to the frame and sash so that both flashing portions overlie a clearance space between the frame and sash in partial overlapping relationship to each other when the sash is positioned in its closed condition; and a pair of hinges, each having a first planar hinge element connected to a respective opposing edge of the frame, and a second planar hinge element arranged in juxtaposition to the first hinge element and connected to the sash, the second hinge element being arranged in a plane spaced from, and in parallel relationship to the first hinge element, each hinge further having a pair of linkages each extending in a single plane and arranged between the first and second elements in co-planar relationship with each other and each pivotally connected to both of the first and second elements, the pivotal connections being so arranged that in use, the flashing on the sash is displaced slidingly out of its overlapping relationship with the flashing on the frame before allowing the rotation of the sash and its associated flashing in excess of 120° from their fully closed to their fully open conditions.

* * * * *